United States Patent [19]

Balian et al.

[11] Patent Number: 4,591,084

[45] Date of Patent: May 27, 1986

[54] METHOD AND APPARATUS FOR FEEDING AND ACCUMULATING RIBBON MATERIAL

[75] Inventors: Basil A. Balian, Fort Wayne; Charles R. Busch, Auburn, both of Ind.

[73] Assignee: Essex Group, Inc., Fort Wayne, Ind.

[21] Appl. No.: 617,309

[22] Filed: Jun. 4, 1984

[51] Int. Cl.[4] ..... B65H 17/42

[52] U.S. Cl. ..... 226/118; 226/186; 226/197; 226/171; 242/58.1

[58] Field of Search ..... 226/24, 25, 26, 36, 226/42, 43, 40, 41, 45, 190, 193, 186, 88, 118, 119, 196, 171; 242/58.1, 58.3

[56] References Cited

U.S. PATENT DOCUMENTS

| | | | |
|---|---|---|---|
| 284,323 | 9/1883 | Palmer | 226/118 |
| 1,087,801 | 2/1914 | McCoy et al. | 226/118 X |
| 1,437,843 | 12/1922 | Heinrichs | 226/186 X |
| 2,180,601 | 11/1939 | Mitchell et al. | 226/118 X |
| 2,395,305 | 2/1946 | Vincent et al. | 226/118 X |
| 2,521,440 | 9/1950 | Bannon | 226/118 X |
| 3,078,023 | 2/1963 | Hecker | 226/118 |
| 3,132,785 | 5/1964 | Kunz | 226/190 X |
| 3,165,276 | 1/1965 | Stone et al. | 242/58.3 |
| 3,261,564 | 7/1966 | Sharpe | 226/118 X |
| 3,332,595 | 7/1967 | Wetzler | 226/119 |
| 3,363,816 | 1/1968 | Maddock | 226/186 |
| 3,599,853 | 8/1971 | Munch et al. | 226/171 |
| 3,645,463 | 2/1972 | Helm | 242/58.1 |
| 3,935,980 | 2/1976 | Groat et al. | 226/43 |
| 4,196,832 | 4/1980 | Kusters et al. | 226/118 |
| 4,324,353 | 4/1982 | Brantley et al. | 226/118 |
| 4,373,362 | 2/1983 | Fleissner | 226/118 X |
| 4,394,951 | 7/1983 | Ruda et al. | 226/118 |

*Primary Examiner*—Harvey C. Hornsby
*Attorney, Agent, or Firm*—Robert P. Hayter

[57] ABSTRACT

Method and apparatus for feeding and accumulating ribbon material is disclosed. The apparatus includes a specific feed mechanism for promoting zig-zag loop folding of the ribbon. The apparatus also includes a reversing means for reorienting a pile of folded zig-zag ribbon material such that ribbon material is inclined backwardly to allow the ribbon to be removed from the top of the pile. Additionally disclosed are an optical array of level sensors for controlling the paper level in a stacking area and a second array for controlling the volume of paper ribbon in a storage area.

10 Claims, 4 Drawing Figures

METHOD AND APPARATUS FOR FEEDING AND ACCUMULATING RIBBON MATERIAL

BACKGROUND OF THE INVENTION

The present invention relates to method and apparatus for accumulating and feeding a ribbon material. More particularly the present invention concerns sensing to maintain a desired paper fold level in feed chute by speed of a take-away conveyor, reversing the lean of a stored zig-zag folded pile of ribbon material such that the ribbon is removed from the top of the pile rather than the bottom, sensing the level of the folded pile in the storage area to control the volume of ribbon supplied to the end use and a specific feed wheel arrangement for acting to stiffen the ribbon to promote zig-zag folding in a desired manner.

It is known in the art to accumulate ribbon material by folding it in a zig-zag pile and delivering it from the pile via a conveyor to an end use. It is, however, an object of the herein apparatus to supply sufficient ribbon material that an end use may be operated continuously while a roll of ribbon material to be unwound is replaced. Hence it is desirable to store up to 5,000 lineal feet of ribbon in a storage area. When dealing with this much ribbon the weight of the ribbon becomes a factor and removing ribbon from the bottom of the pile with the weight of the entire pile placed thereon creates a potential for the ribbon to break.

Means are provided for reversing the lean of the pile as it is transported away from the stacking area such that the pile is inclined backwardly and additional ribbon being removed therefrom is removed from the bottom of the pile. Hence the weight of the pile is no longer on the portion of the ribbon being removed and the integrity of the ribbon through the process is greatly increased.

An array of optical level detectors includes a plurality of rows of level detectors spaced through the stacking area to sense the height of ribbon pile present. By sensing the top layer of the pile, the take-away conveyor speed to maintain the pile at the desired level may be varied. If the pile becomes too high, the conveyor speed is increased whereas if the pile height is insufficient the conveyor speed is decreased while the feeder roller rate remains constant.

Additionally the herein invention includes the utilization of tire-like members located on the feed wheels. These tire members have a width less than the width of the ribbon passing therebetween. By acting on only a portion of the ribbon the tires act to slightly deform the ribbon thereby stiffening the material. By stiffening the material, the manner in which the ribbon is folded in the zig-zag pile is regulated. When the ribbon is stiffer it tends to fold in a zig-zag pile having large loops as desired.

SUMMARY OF THE INVENTION

It is an object of the present invention to provide method and apparatus for storing large amounts of ribbon material.

It is another object of the present invention to provide apparatus and a method for reversing the lean of a pile of ribbon material.

It is a still further object of the present invention to provide a storage means for ribbon material wherein the ribbon material may be removed from the top of the storage pile.

It is a still further object of the present invention to provide sensing means for detecting the level of a pile of folded ribbon and to control a take-away conveyor speed based upon that level.

It is a yet further object of the present invention to provide feed wheels capable of stiffening the ribbon material to promote even zig-zag folding of the pile.

It is a further object of the present invention to provide a combination feeder and accumulator assembly capable of storing a large amount of ribbon material and capable of feeding that material without breaking to an end use.

It is another object of the herein invention to provide apparatus and a method for reliably, safely and with a minimum of breakage, storing and supplying ribbon material to an end use.

It is another object of the present invention to provide sensing means for maintaining a desired level of paper ribbon by controlling the feed rate of incoming paper.

Other objects will be apparent from the description to follow and the appended claims.

The above objects are achieved according to a preferred embodiment of the invention by the provision of apparatus for accumulating and feeding ribbon. This apparatus includes a feed chute for receiving ribbon and wherein the ribbon stacks into a zig-zag folded pile, feed means for supplying ribbon to the feed chute, a stacking area including a ramp conveyor for moving the continuous zig-zag folded pile towards a storage area, said pile having a forward lean, a storage area including a storage conveyor for receiving the pile from the stacking area, said storage area being sufficiently large to store the desired amount of ribbon in a zig-zag folded pile, and reversing means extending to engage the pile as it travels along a conveyor, said reversing means engaging the forward leaning pile in a stacking area while the ramp conveyor and storage conveyor are advancing the pack to effectively create a backward leaning pile in the storage area.

Additionally disclosed is a method of feeding an accumulating ribbon which includes the steps of stacking the ribbon in a zig-zag folded pile, removing ribbon from the bottom of the pile, reversing the lean of the ribbon removed from the bottom of the pile, and transporting the now-reversed lean ribbon to a storage area where the ribbon is now removed from the top of the pile.

DESCRIPTION OF THE PREFERRED EMBODIMENT

Figure 1:
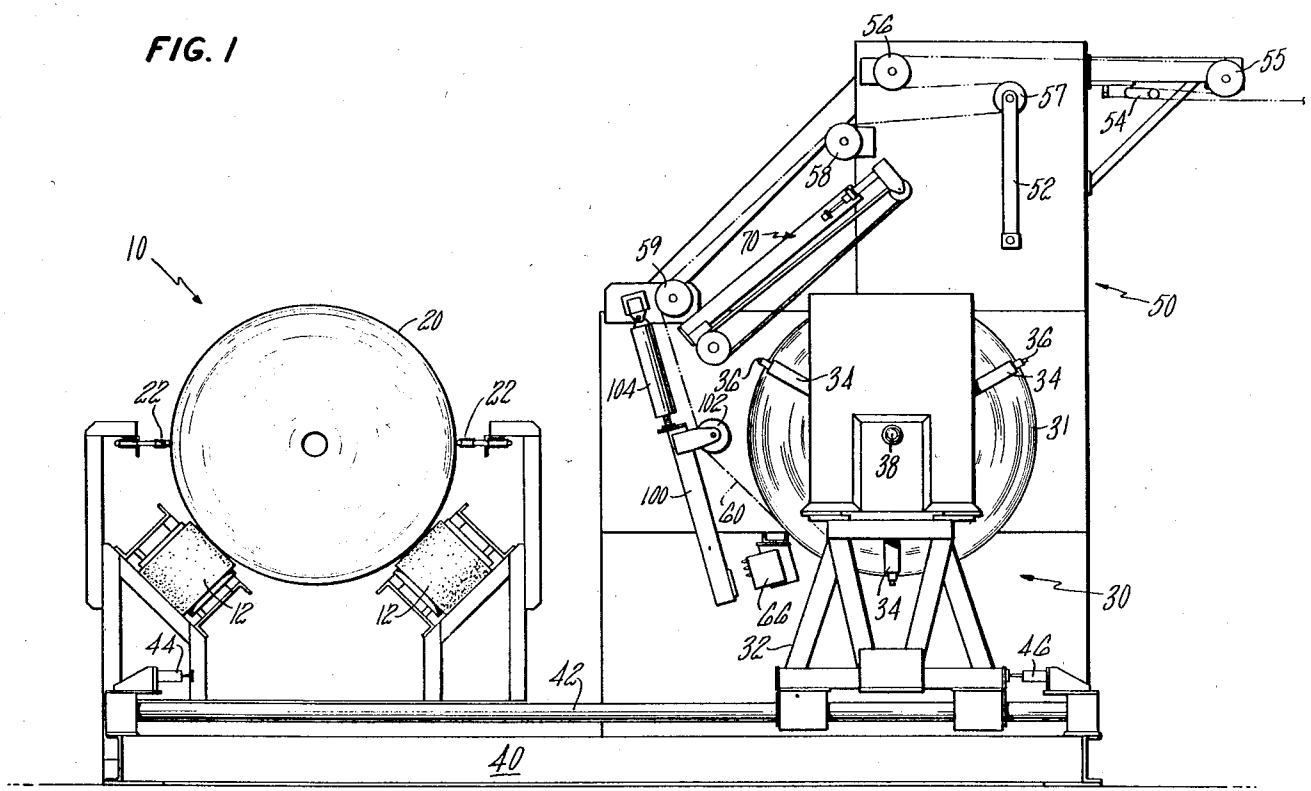
FIG. 1 is a front plan view of a conveyor assembly, robot assembly and paper payoff assembly.
Figure 2:
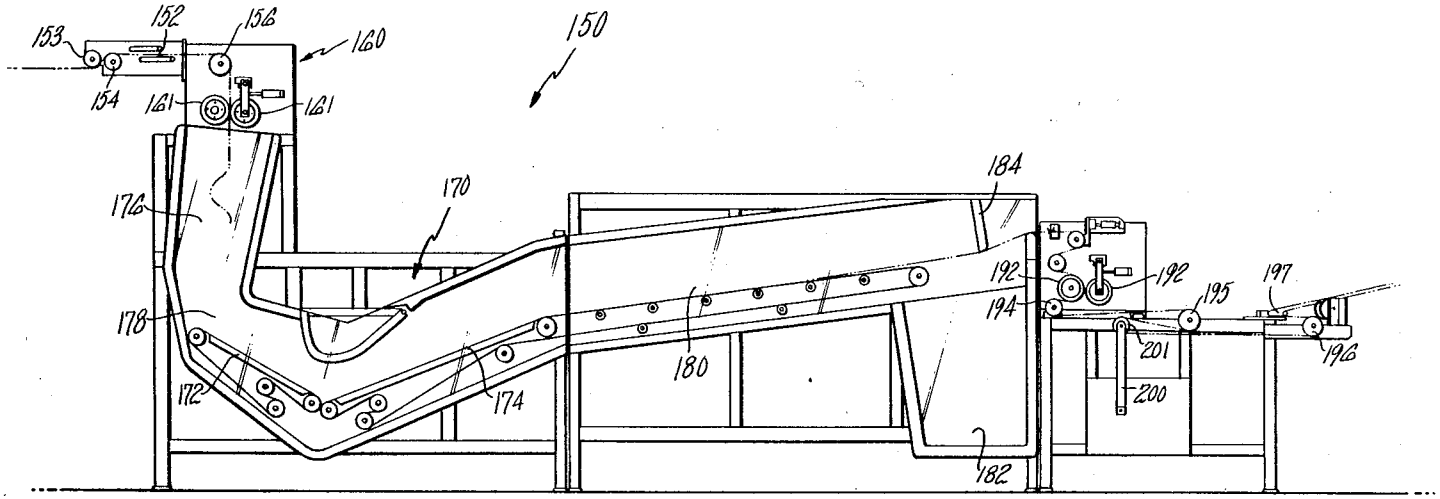
FIG. 2 is a front plan view of a ribbon feeder and accumulator assembly and feed-up assembly.

Referring to FIGS. 1 and 2 there may be seen a front plan view and a partial top view of a complete ribbon feed system for supplying paper ribbon from large rolls of ribbon to an end use at a high rate of speed. It is anticipated that ribbon as required for a particular use may come in rolls up to three feet in diameter and may be of varying widths. The specific use for which the herein equipment was designed is to supply paper to a wire production facility. This paper ribbon typically has a width between one and one and a half inches. It is desirable to supply the paper at speeds in the 2,000–5,000 feet per minute range. This ribbon supply system could, of course, be used for other applications and with rolls of paper stock or other material of varying sizes.

Each paper roll of the dimensions mentioned contains approximately 17,000 lineal feet of paper. At the desired unwinding speeds an individual paper roll is completely consumed in 4–9 minutes. The equipment herein is designed to allow another roll to be mounted automatically and joined to the previous roll such that the wire production facility may operate continuously including operating without interruption when paper rolls are being changed. Absent such automatic machinery it would be necessary to provide attendants for the purpose of loading paper rolls.

FIG. 1 is front plan view of a conveyor assembly, a paper payoff assembly and a robot assembly. Conveyor assembly 10 consists of two parallel mounted conveyor belts 12 having a series of paper rolls 20 stacked vertically therebetween. The length of the conveyor belts depends upon the number of paper rolls desired to be mounted on the conveyors at one time. The length is theoretically unlimited. The conveyor assembly includes means to advance the conveyor belts to move paper rolls 20 forward to a position where robot assembly 30 may grasp and remove the roll from the conveyor belts. Position sensors 22 are shown located one on either side of the paper roll to indicate that the paper roll has been advanced to a pickup position. The conveyor belts are typically operated to advance the paper rolls until the position sensors are tripped by contact with the paper roll.

Robot assembly 30 is mounted on rails 42 for left-to-right motion as seen in FIG. 1. Position stops 44 and 46 are utilized to control the position of robot assembly 30. Robot assembly 30 includes arms 34 containing clamp jaw mechanisms for securing paper roll 31. A central shaft for allowing rotation of the entire paper roll is further provided. The robot assembly may traverse to the left, mechanically grasp and remove a paper roll from the conveyor assembly, and thereafter traverse to the right until aligned with the paper payoff assembly. The robot assembly then acts to position the paper roll on paper payoff assembly 50. Once the paper roll is on paper payoff assembly 50 paper ribbon 60 is directed over pulleys 102, 59, 58, 57, 56, and 55 serially. The ribbon then passes over angle bar 54 and continues to the ribbon feeder and accumulator assembly 150 of FIG. 2. Paper payoff assembly 50 further includes a paster arm assembly 100, glue applicator 66, drive belt assembly 70, and dancer arm 52. The paster arm assembly includes apparatus for holding and cutting the ribbon after a paper roll has been unwound. Glue applicator 66 is utilized to provide adhesive to the tail end of the consumed paper roll such that the tail end of the ribbon from the consumed paper roll may be connected to the beginning portion of the ribbon of the new roll mounted on the paper payoff assembly by the robot assembly.

Drive belt assembly 70 consists of a drive belt operated to rotate the paper roll at a desired speed to supply ribbon to the end use. The ribbon passes over pulley 57 which is mounted on dancer arm 52. The position of dancer arm 52 is used to control the speed of drive belt 70 for regulating the payoff rate of ribbon 60.

FIG. 2 is a front plan view of a ribbon feeder and accumulator assembly 150. The ribbon feeder and accumulator assembly is utilized to store sufficient ribbon such that during the time interval between the consumption of one paper roll and the mounting of a new paper roll by the robot assembly, that the process to which the paper is supplied may continue to operate with paper being continuously supplied from the ribbon feeder and accumulator assembly. To supply paper for this interval when no paper is being unwound, it is necessary to store a sufficient quantity of paper that operation of the end use may continue. Under the circumstances described it might be appropriate to store from 1,000–5,000 lineal feet of paper ribbon in the feeder and accumulator assembly.

The ribbon feeder and accumulator assembly includes paper feeder 160 and the paper accumulator 170 having feed chute 176, stacking area 178 and storage area 180. Ribbon is supplied through pulleys 153 and 154, through static eliminator 152 and around pulley 156 to feed wheels 161. Feed wheels 161 direct the ribbon into the stacking area and include urethane tire-like portions for effectively stiffening the ribbon such that it is directed in a straight path resulting in the ribbon being folded in large loops in the stacking area. Stacks of ribbon from the stacking area are conducted by ramp conveyor belt 172 downwardly and to the right. Storage conveyor belt 174 then directs the stacks of ribbon into storage area 180. The pack lean reversing shoe 175 is positioned to create a resistance at the top portion of the folds such that as the folds of paper are switched from ramp conveyor belt 172 to storage conveyor belt 174 the direction of lean of the folds is reversed. Reversing the direction of lean of the paper in the storage area allows the paper to be removed from the storage area without pulling the paper from the bottom of the pack thereby reducing the force required to physically pull the paper from the storage area. Spill box 182 is utilized to store excess folds when inadvertently dumped thereinto. Fold stripper 184 acts to remove the folds from the paper.

Feed-up assembly 190 includes supply wheels 192 for supplying paper to the end use at production line speed, pulleys 194, 195, 196, 197 and dancer 200 having pulley 210. The position of dancer 200 is sensed and thereafter used to trim the rate of rotational speed of the supply wheels to provide constant tension in the paper ribbon from the end use. The remaining pulleys simply act to guide the paper through the feed-up assembly.

Figure 3:
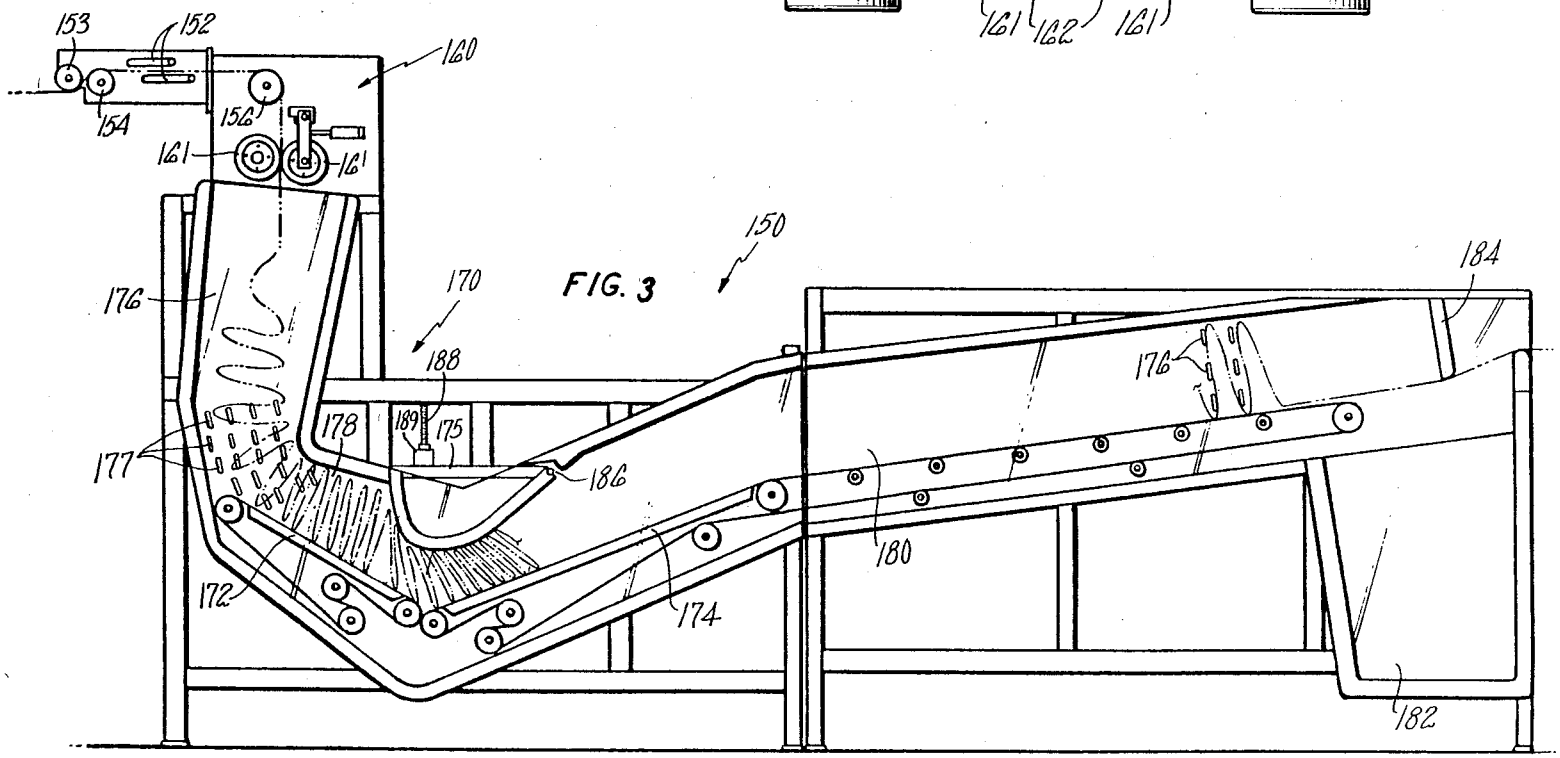
FIG. 3 is an enlarged front plan view of the ribbon feeder and accumulator assembly.

Referring now to FIG. 3 there may be seen an enlarged view of ribbon feeder and accumulator assembly 150. In this view it may be seen that level detectors 177 are provided in the stacking area 178 of paper accumulator 170. Multiple detectors are used to assure proper level sensing of folded paper. The paper must stack at a specific height in the stacking area to promote the desired length and density of folds. If the paper does not reach the desired level, then the mechanism acts to slow down conveyor belts 172 and 174 which are joined by a chain drive, allowing more folds to accumulate in the stacking area. If the level indicators indicate too much paper is present than the conveyor belts speed up moving more folds away from the stacking area.

Level detectors 177 are also used at the end of storage area 180 to sense the fill level of the accumulator and effect the system by regulating the rotational velocity of feed wheels 161. When the accumulator is filling, the feed wheels are operated at a rate above the production line speed. When the accumulator is full, the feed wheels are operated at line speed to maintain the desired volume of the paper ribbon, or stop completely if there is an overflow of ribbon in the accumulator.

Figure 4:
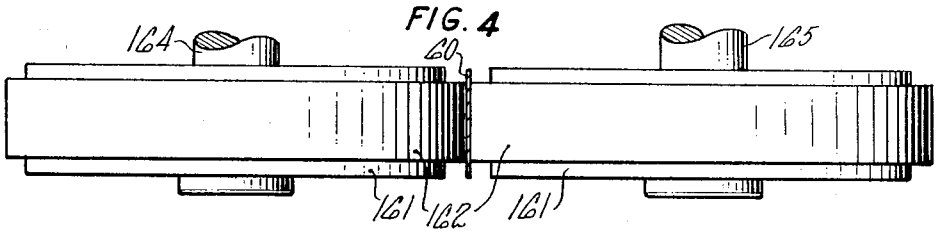
FIG. 4 is a top view of feed wheels supplying the ribbon feeder and accumulator assembly.

Feed wheels 161 each include as shown in FIG. 4 urethane tires 162 extending about the perimeter thereof. These urethane tires are significantly less in width than the size of paper ribbon 60. One feed wheel is driven by shaft 164 and the second serves as a nip wheel turning on shaft 165. The feed wheels are driven at a rate higher than the production line speed while the accumulator is filling and at line speed when full.

By utilizing urethane tires of less dimension than the paper a stiffening effect is provided to the ribbon such that the paper ribbon is directed downwardly in a generally straight line and having increased stiffness. By increasing the stiffness, the paper will proceed downward in a relatively straight line and then will make large back and forth folds in the desired manner. Hence, the stiffening effect created by utilization of the urethane tires causes the paper to descend deep enough into the feed chute to develop the desired fold length. As the paper starts folding and accumulating in the stacking area 178, conveyor belt 172 acts to move the paper from left to right. Eventually the paper engages storage conveyor belt 174 which moves the paper from left to right through the storage area 180. Since the paper being accumulated in the stacking area is being fed from the top, the bottom of the paper is underneath and is subject to the weight of the accumulated paper. Hence, removing paper from the bottom might cause additional stress in the paper since the weight of the accumulated paper acts thereon. A pack lean reversing shoe 175 is provided in conjunction with the conveyors for redirecting the direction of lean of the paper such that the paper is always removed from the top of the stack rather than the bottom. Pack lean reversing shoe 175 is pivotally mounted at pivot point 186 and extends an adjustable distance into the paper path area. Threaded rod 188 cooperates with position adjuster 189 to place the shoe in the desired position. Hence, as the pile of paper is directed along ramp conveyor belt 172 it is forced to have its top surface engage the edge of reversing shoe 175. When storage conveyor belt 174 engages the paper it acts to draw the bottom of the paper through while the top of the paper engages the exterior surface of pack lean reversing shoe 175 such that the bottom of the paper is now placed in an uppermost position. The paper may be removed from a position on top of the pile without the weight of other paper acting thereon such that the potential for the ribbon breaking is significantly reduced.

Fold stripper 184 is positioned within spill box 182 such that should the paper fail to unfold as it is being withdrawn it will engage stripper 184 which will act to shake the folds out of the paper. When this happens the paper simply drops into spill box 182 prior to being withdrawn from the ribbon feeder and accumulator assembly.

The invention has been described with reference to a particular embodiment. It is to be understood by those skilled in the art that variations and modifications can be effected within the spirit and scope of the invention.

We claim:

1. Apparatus for accumulating and feeding a paper ribbon which comprises:

a feed chute for receiving ribbon and wherein the ribbon stacks into a zig-zag folded pile;

feed means for supplying ribbon to the feed chute;

a stacking area including a ramp conveyor for moving the continuous zig-zag folded pile towards a storage area, said pile having a forward lean;

a storage area including a storage conveyor for receiving the pile from the stacking area, said storage area being sufficiently large to store the desired amount of ribbon in a zig-zag folded pile;

reversing means extending downwardly to engage only the top portion of the pile as it travels along the conveyors, said reversing means engaging the top portion of the forward leaning pile while the ramp conveyor and storage conveyor are advancing the bottom of the pile to effectively create a backward leaning pile in the storage area such that as the ribbon is removed from the storage area it is removed from the top of the pile; and said reversing means is a rounded structure adjustably mounted to regulate the extent the reversing means extends downwardly which regulates the amount of contact with the pile such that the direction of lean of the pile may be reversed without applying unnecessary resistance to the pile, said reversing means being sufficiently spaced from the conveyors to allow the zig-zag folded pile to be conveyed therebetween with the pile oriented in a substantially upright manner.

2. The apparatus as set forth in claim 1 wherein the ramp conveyor slopes downwardly, the storage conveyor slopes upwardly and the reversing means engages the pile at the transition between the ramp conveyor and the storage conveyor.

3. The apparatus as set forth in claim 1 and including an array of optical level detectors arranged in the stacking area to detect the level of the pile, said level detectors acting to regulate the speed of the ramp conveyor and the storage conveyor in response to the level detected.

4. The apparatus as set forth in claim 1 and including an array of optical level detectors arranged at the end of the storage area to detect the volume of ribbon in the storage area, said feed means acting to regulate the speed of the ribbon supplied in response to the level detected in the storage area.

5. The apparatus as set forth in claim 1 wherein the feed means comprises a pair of feed wheels, each wheel having an annular tire about the diameter thereof, said tire having a width less than the width of the ribbon, and the ribbon passing between the tires of the feed wheels, said feed wheels being positioned such that the annular tires deform a portion of the ribbon which acts to stiffen the ribbon and promote folding of the ribbon in the chute in a desired zig-zag fashion.

6. A method of feeding and accumulating paper ribbon which comprises the steps of:

stacking the ribbon in a zig-zag folded pile;

removing ribbon from the bottom of the pile with the pile oriented in a generally upright manner and having a forward lean;

reversing the lean of the ribbon removed from the bottom of the pile by displacing the bottom of the ribbon pile while simultaneously engaging a forward leaning top portion at a location spaced from the bottom portion of the pile to effectively reverse the direction of lean of the pile while the pile remains oriented in an upright direction; and transporting the now-reversed lean ribbon to a storage area where the ribbon may now be removed from the top of the pile.

7. The method as set forth in claim 6 and further comprising the step of:

feeding and stiffening the ribbon prior to the step of stacking to propel it a prescribed distance, thereby developing folds of ribbon of a desired length.

8. The method as set forth in claim 6 and further comprising:

sensing the level of the pile of ribbon from the step of stacking; and regulating the steps of removing and transporting the ribbon based on the level of ribbon detected.

9. The method as set forth in claim 8 and further comprising the steps of:

sensing the level of ribbon in the storage area; and regulating the rate of feeding ribbon based on the level of ribbon detected in the storage area.

10. Apparatus for accumulating and feeding paper ribbon which comprises:

a feed chute for receiving ribbon and wherein the ribbon stacks into a zig-zag folded pile;

feed means for supplying ribbon to the feed chute;

a stacking area including a ramp conveyor for moving the continuous zig-zag folded pile towards a storage area, said pile having a forward lean;

a storage area including a storage conveyor for receiving the pile from the stacking area, said storage area being sufficiently large to store the desired amount of ribbon in a zig-zag folded pile;

an array of optical level detectors arranged at the end of the storage area to detect the volume of ribbon in the storage area, said feed means acting to vary the speed of the ribbon supplied in response to the level detected in the storage area; and a second array of optical level detectors arranged in the stacking area to detect one of many potential multiple levels of the pile, said level detectors acting to vary the speed of the ramp conveyor and the storage conveyor in response to which level is detected.

* * * * *